US005761566A

United States Patent [19]

Suzuki et al.

[11] Patent Number: 5,761,566

[45] Date of Patent: Jun. 2, 1998

[54] IMAGE OUTPUT DEVICE HAVING FUNCTION FOR JUDGING INSTALLATION OF GENUINE CARTRIDGE AND METHOD FOR DETERMINING AUTHENTICITY OF THE CARTRIDGE

[75] Inventors: Makoto Suzuki, Nagoya; Takaaki Suzuki, Toyoake, both of Japan

[73] Assignee: Brother Kogyo Kabushiki Kaisha, Nagoya, Japan

[21] Appl. No.: 763,263

[22] Filed: Dec. 10, 1996

[30] Foreign Application Priority Data

Dec. 28, 1995 [JP] Japan ..... 7-343159

[51] Int. Cl.[6] ..... G03G 15/00

[52] U.S. Cl. ..... 399/12; 399/13; 400/207

[58] Field of Search ..... 399/12, 13; 340/825.34; 382/204; 101/336; 400/207; 347/86

[56] References Cited

U.S. PATENT DOCUMENTS 4,963,939 10/1990 Kurando et al. ..... 399/12
4,978,995 12/1990 Takahashi ..... 399/12
5,075,724 12/1991 Wada et al. ..... 399/12
5,365,312 11/1994 Hillmann et al. ..... 399/12

FOREIGN PATENT DOCUMENTS

A-2 201 945 9/1988 Germany .
A-63-224986 9/1988 Japan .
A-5-224479 9/1993 Japan .

*Primary Examiner*—Joan H. Pendegrass
*Attorney, Agent, or Firm*—Oliff & Berridge, PLC

[57] ABSTRACT

A printer and a toner cartridge detachably provided in a printer body. The toner cartridge is provided with a specific uneven pattern or logo mark at an outer surface thereof. The printer has first and second detection switches for identifying the uneven pattern. Co-relation is established between a specific position of the uneven pattern and height of the specific position, and each detection switch is set so as to confront with the specific position. The first and second detection switches serve to detect the projected part, and the recessed part, respectively. If the first detection switch detects the recessed part, or if the second detection switch detects the projected part, the installed cartridge is judged to be a pirated cartridge.

20 Claims, 10 Drawing Sheets

IMAGE OUTPUT DEVICE HAVING FUNCTION FOR JUDGING INSTALLATION OF GENUINE CARTRIDGE AND METHOD FOR DETERMINING AUTHENTICITY OF THE CARTRIDGE

BACKGROUND OF THE INVENTION

The present invention relates to an image output device which detachably installs therein a cartridge. The present invention also relates to a method for determining authenticity of a cartridge installed in the image output device.

In a conventional image output device, output image is formed by image forming medium such as toners or ink, and images are formed on an image receiving medium such as a tape or printing sheet.

An electrophotographic type printer is known as a conventional image output devices in which a toner cartridge is detachably installed. Further, an ink jet type printer is also known in which an ink cartridge containing ink is installed for outputting images on a printing paper with an ink-jet system. Since such toner and ink are expendables for directly forming a visual image on a printing paper, once the image forming medium in the cartridge is exhausted, image output operation cannot be attained any more. Thus, it is replaced with a new cartridge.

In addition, recently, a tape output device or a tape printer has been proposed and put in the market. The tape printer has a cartridge containing therein an ink ribbon as the image forming medium, and a tape as the image receiving medium. Ink on the ink ribbon is heat sensitively transferred onto the tape to produce an inked image on the tape. Also in this tape output device, once the contained tape and/or ink ribbon is exhausted, the cartridge is replaced with a new one.

Generally, for such a image output device, it is preferable to use a cartridge containing a genuine recording medium as a supply part the quality of which the manufacturer guarantees according to its structure and requirements. However, for such cartridge, although the manufacturer develops the image forming and receiving mediums suitable for each image output device, and supplies it to the market, it is actual situation due to cost or other factors that many cartridges containing a pirated recording material which the manufacturer does not guarantee are distributed. This is because it is easily imitated due to its nature as consumables or expendables.

Such pirated cartridge is not covered by the warranty of the manufacturer of the output device, and, in some worst cases, the cartridge falsely bears the brand name of the manufacturer of the output device, which causes the user to misunderstand the source. In addition, if the brand name is not indicated, even if any trouble occurs in the printed image only due to use of the pirated cartridge, the user cannot have remedy and only confusion is arisen in the market. Moreover, in such case, it is rather difficult to make the user consent that no warranty is provided because it is a pirated product, leading to many troubles.

To solve such problems, it is contemplated to provide a bar code or the like on a cartridge, and to mount a bar code sensor on the image output device for reading the bar code, so that only a genuine cartridge from the manufacturer can be used. However, such approach is hardly employed because it becomes necessary to use an expensive sensor as an arrangement for reading the bar code, leading to significant cost increase for the image output device.

Further, as described in Japanese Patent Application Kokai (Laid-Open) No. Sho-63-224986, a projection in a form of trademark is provided on a cartridge, the projection being divided into a number of sections with different height, and a number of switches are provided in correspondence to the respective sections. When the cartridge is installed in the image output device, each switch is turned ON or OFF on the basis of the height of respective sections, thereby enabling operation of the image output device only when the pattern of ON/OFF exactly matches a predetermined ON/OFF pattern or distribution.

However, even such device requires a number of switches, causing significant increase in cost of the image output device. In addition, because it is necessary to vary the height of the projection according to the sections, the height of the projection becomes higher as the number of sections is increased, which increases the accommodation space for the cartridge. In addition, sufficient attention should be paid on damage of the projection.

SUMMARY OF THE INVENTION

It is therefore, an object of the present invention to overcome the above described drawbacks, and to provide an improved image output device capable of avoiding installation of a pirated cartridge without increasing installation space for the cartridge with high durability and without increase in production cost.

Another object of the present invention is to provide a method for determining authenticity of a cartridge to be accommodated in the image output device so as to prevent the pirated cartridge from being used for the image outputting operation.

These and other objects of the present invention will be attained by providing an image output device to be used in combination with a cartridge, the cartridge including a cartridge wall and a predetermined uneven pattern, and the image output device including a cartridge installing portion, means for detecting unevenness of the uneven pattern and means for suppressing image outputting operation. The cartridge wall contains therein an image forming medium, and the predetermined uneven pattern is formed on an outer surface of the cartridge wall. The uneven pattern includes a projected region containing a plurality of projected points and a recessed region containing a plurality of recessed points. The cartridge installing portion is adapted for detachably installing therein the cartridge. The cartridge installing portion provides a detecting position. The detecting means is adapted for detecting unevenness of the uneven pattern at the detection position. The detecting position is previously determined so as to confront with a predetermined one of the plurality of projected or recessed points in the uneven pattern, and the detection means generates signal indicative of either projected point or recessed point. The suppressing means is adapted for suppressing image outputting operation based on the detection signal from the detection means if the detecting means detects one of the projected or recessed points other than the predetermined one of the projected or recessed point.

In another aspect of the present invention, there is provided a method for determining authenticity of a cartridge installed on a cartridge receiving portion of a body of an image output device, the method comprising steps of forming step, determining step, co-relating step, judging step and second determining step. In the forming step, a predetermined uneven pattern is formed on a cartridge containing therein expendables, the uneven pattern includes a projected region containing a plurality of projected points and a recessed region containing a plurality of recessed points. In the first determining step, at least one specific detecting position is determined. In the co-relating step, the specific detecting position is co-related with a specific point of the uneven pattern so as to determine the detecting position as being a position in confrontation with one of predetermined projected points or recessed points. In the judging step, judgment is made as to whether or not the detecting position confronts one of the predetermined projected points or the recessed points. In the second determining step, authenticity of the cartridge installed in the cartridge receiving portion is determined based on the judging step.

DETAILED DESCRIPTION OF THE PREFERRED EMBODIMENTS

Figure 1:
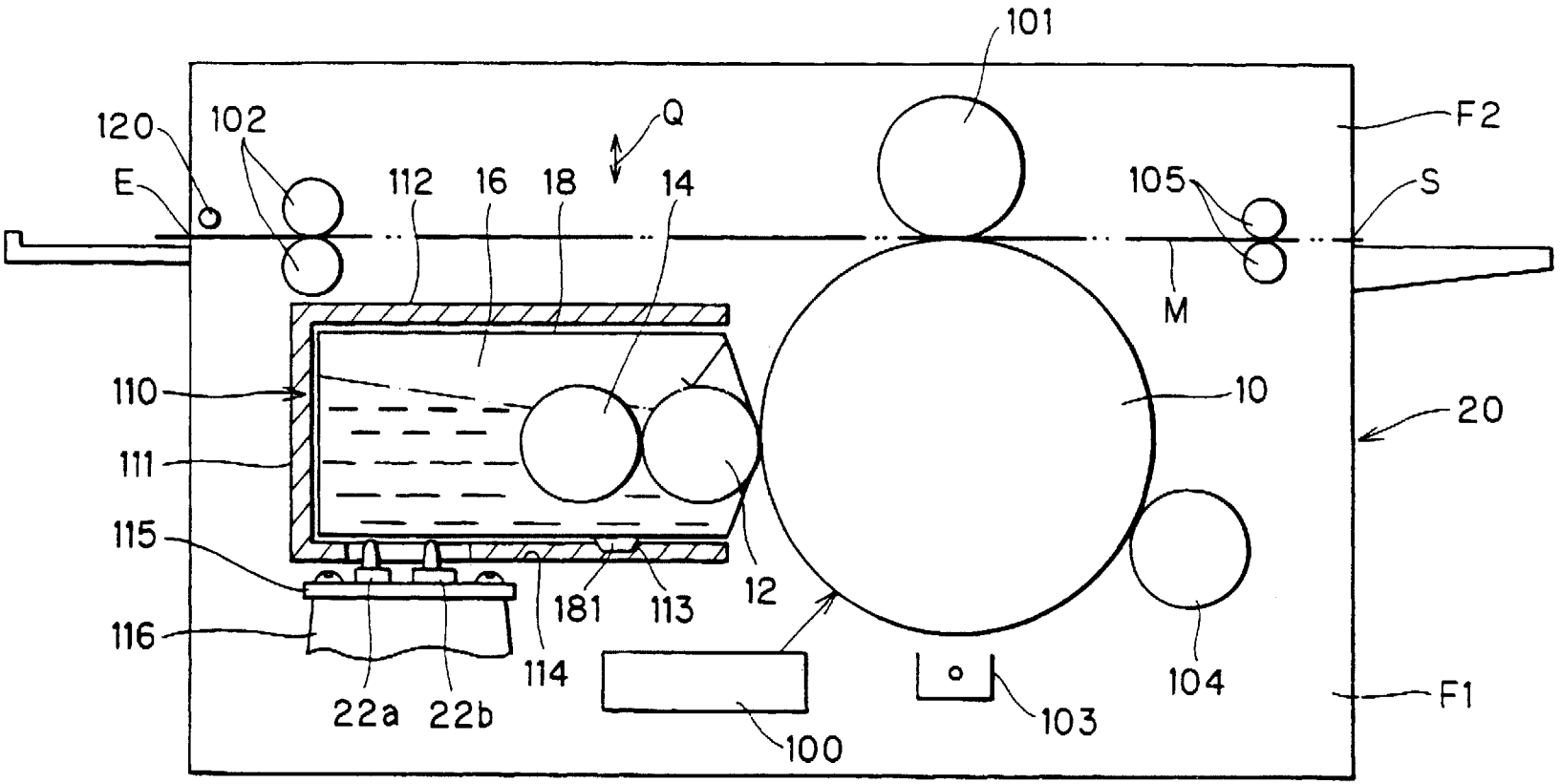
FIG. 1 is a schematic diagram showing an internal arrangement of an electrophotographic type printer according to a first embodiment of the present invention.

An image output device according to one embodiment of the present invention will be described with reference to FIG. 1 in which an electrophotographic printer is delineated.

The printer has a printer body 20 in which a process cartridge (toner cartridge) 18 is detachably installable. In the printer body 20, are provided a photosensitive roller 10, a charger 103 for charging the photosensitive roller 10, an exposure unit 100, the process cartridge 18, a transfer roller 101, and a cleaning roller 104. The exposure unit 100 includes an optical scanner for exposing the photosensitive roller 10 to laser beam according to image information to form an electrostatic latent image on the photosensitive roller 10. The process cartridge 18 is adapted for depositing toner on the latent image to form a visible toner image on the photosensitive roller 10. The transfer roller 101 is adapted for transferring the toner image on the photosensitive roller 10 onto an image receiving medium such as a paper while nipping the paper between the photosensitive roller 10 and the transfer roller 101. The cleaning roller 104 is adapted for removing the toner remaining on the photosensitive roller 10 after the transfer of the toner image onto the paper.

The printer body 20 has a sheet insert port S and a sheet discharge port E. In the printer body 20, there are further provided paper feed roller 105, a fixing roller 102 and a cartridge positioning portion 110. The paper feed roller 105 is adapted for feeding the printing sheet inserted through the sheet insert port S to the photosensitive roller 10. The fixing roller 102 is adapted for heating and fixing the toner image to the printing sheet and for discharging the sheet through the paper discharge port E.

The process cartridge 18 includes a toner box 16, a developing roller 12 for supplying the toner to the photosensitive roller 10 to form the visible image corresponding to the electrostatic latent image on the photosensitive roller 10, and a toner supply roller 14 for supplying the toner to the developing roller 12 from the toner box 16. The process cartridge 18 has a tapered positioning projection 181 projecting from an outer surface thereof. The process cartridge 18 is held at a predetermined position by the cartridge positioning portion 110 provided on the printer body 20.

The positioning portion 110 is fixed on a lower frame F1 of the printer body 20, and constituted by a receiving member 111 with an L-shaped section and an upper holding member 112. The receiving member 111 is formed with a tapered recess 113 engageable with the tapered positioning projection 181, so that the cartridge 18 can be accurately positioned in the cartridge positioning portion 110. When the process cartridge 18 is replaced, an upper frame F2 above a paper passage M is pivotally moved upward about a pivot shaft 120, and then, the holding member 112 is removed to remove the process cartridge 18 in the direction of an arrow Q in FIG. 1. In this printer, when image formation is performed in a number of times, the toner in the toner box 16 of the process cartridge 18 is used up, so that the output images gradually become paler, and, ultimately a desired image cannot be formed on the image receiving sheet. In such case, the process cartridge 18 is replaced with a new one.

A through-hole 114 is formed on the receiving member 111 at a location corresponding to an uneven pattern (described later) formed on the surface of the cartridge 18. Below the through hole 114, a mounting base 116 is mounted on the lower frame F1 for securing a detection circuit board 115.

Next, an authenticity determination section of the process cartridge 18 will be described with reference to FIGS. 1 through 7.

Figure 2:
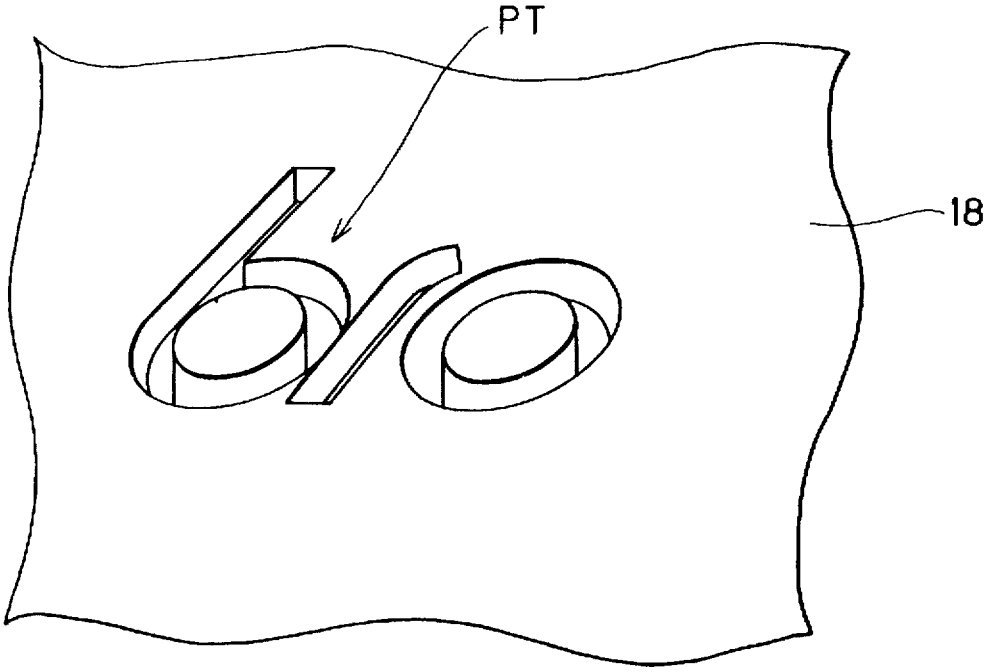
FIG. 2 is a view showing an example of uneven pattern formed on a surface of a toner cartridge according to the first embodiment.

As shown in FIG. 2, an uneven pattern such as a logo mark PT which is indicative of the name of a company or product is formed in the surface of the process cartridge 18.

The uneven pattern is formed by engraving an outer bottom wall of the cartridge 18 to provide a recessed or grooved logo mark PT. Since the main body of the process cartridge 18 can be produced by a molding with resin, the uneven pattern can be easily formed on the surface of the cartridge 18 by forming the corresponding uneven pattern on the surface of a metal mold.

Because the logo mark PT identifies the name of a product or company, if the pirated product also bears the identical logo mark, this directly causes false indication.

Because the false indication is a good reason for suspending illegal sales activity of the pirate, such a logo mark is advantageous for protecting the benefit of both the true manufacture and the user.

Figure 4:
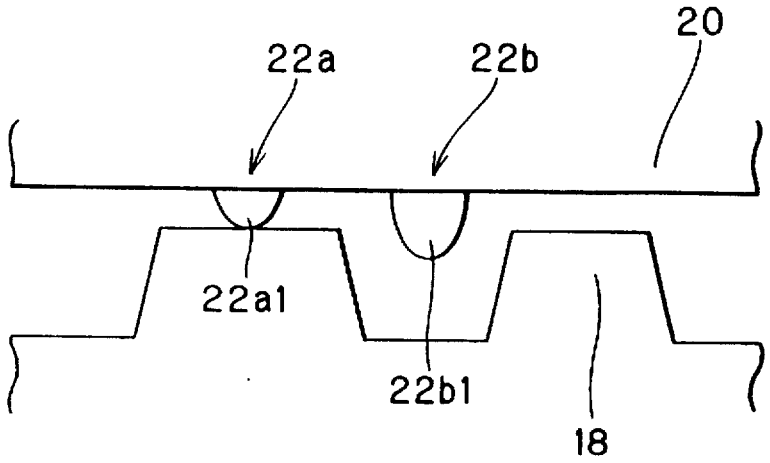
FIG. 4 is a diagram illustrating ON or OFF state of the detection switches when the toner cartridge is accommodated in a printer body.

On the other hand, the printer body 20 is provided with detection switches 22*a* and 22*b* as shown in FIG. 4 at positions in confrontation with the uneven pattern PT of the process cartridge 18 when the process cartridge 18 is positioned and held by the positioning section 110. These detection switches 22*a* and 22*b* are mechanical switches and of normally open contact type switches. The switches have small actuator sections 22*a*1 and 22*b*1 normally projectedly urged by a spring (not shown), and can be turned ON if the mall actuator sections are pressed against the biasing force of the spring when the process cartridge 18 is installed at the predetermined position.

Figure 3:
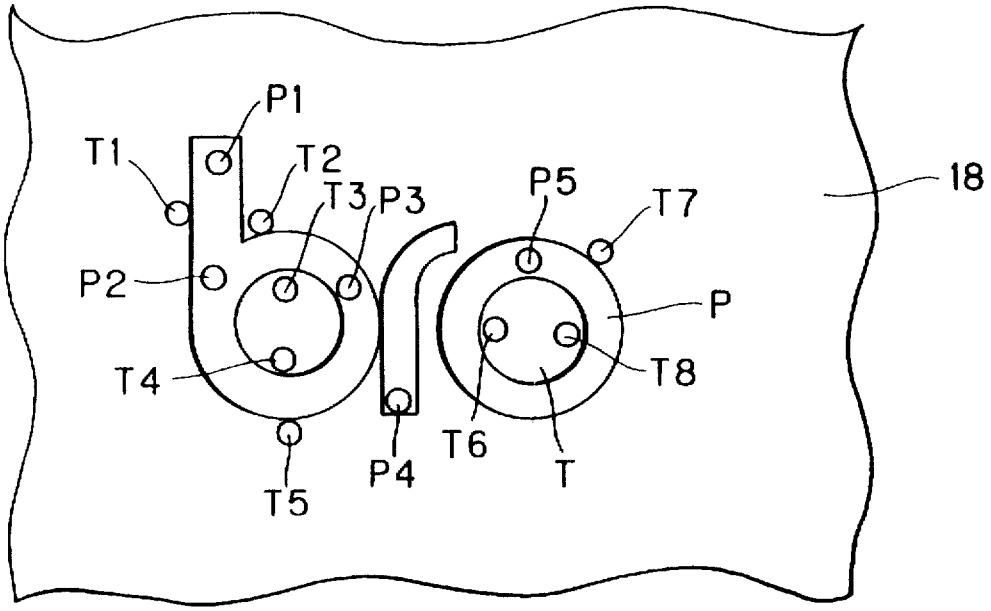
FIG. 3 is a diagram illustrating detecting positions of detection switches according to the first embodiment.

The position of the switches can be freely selected as shown in FIG. 3, among any position within the contour of the recessed groove P of the uneven pattern on the cartridge 18 (P1, P2, P3, P4, P5, . . . ) and any position on a raised region T (non-engraving portion) on the cartridge surface (T1, T2, T3, T4, T5, T6, T7, T8, . . . ). That is, the detection positions of the switches 22*a* and 22*b* are selected from these positions. Therefore, even if only a single uneven pattern (logo mark) is provided on the cartridge 18, the various positions T1, T2, . . . and P1,P2 . . . are all indicative of the true process cartridge produced by the true manufacture. In other words, since the uneven pattern formed on the surface of the cartridge 18 accommodates all positions (P1, P2, . . . , T1,T2, . . . ) contemplated for detection by the switches 22*a* and 22*b*, only one type of uneven pattern is sufficient.

In addition, the size of the through hole 114 is preferably determined to be a size capable of accepting the entire uneven pattern. With this arrangement, it eliminates necessity to vary the position of the through hole 114 in the receiving member 111 depending on the detection position. Since the correspondence between the position and the height has already been determined with respect to the uneven pattern of the cartridge 18, judgment of true cartridge can be easily made by detecting the height of the uneven pattern at the selected position.

Further, positions of these switches 22*a* and 22*b* with respect to the detection circuit board 115 are varied by a predetermined number of lots (number of products manufactured), the detection circuit board 115 being secured at a fixed location in the printer body 20. For example, in the first lot, the lower position P2 and the upper position T7 are selected as the detecting positions. Then, in a second lot, the lower position P3 and the upper position T8 are selected as the positions of the switches 22*a* and 22*b*. By this change of the detecting positions at every producing lot, the pirate must continuously produce completely identical uneven pattern in all pattern area, otherwise the pirated product can be easily detected.

FIG. 4 is a state of the switches 22*a* and 22*b* when the process cartridge 18 is mounted on the printer body 20. The switch 22*a* is retracted or closed (turned ON) because the small actuator section 22*a*1 is pressed by the projected portion of the uneven pattern of the process cartridge 18. On the other hand, the switch 22*b* remains open (turned OFF) because its small actuator section 22*b*1 is in the recessed groove in the uneven pattern. By detecting ON/OFF states of the switches 22*a* and 22*b* when the process cartridge 18 is mounted, it is possible to determine not only mounting of the cartridge, but also whether a proper and genuine process cartridge is mounted. In other words, authenticity of the cartridge can be determined.

In the depicted embodiment, when the detection switch 22*a* is turned ON and the detection switch 22*b* is turned OFF, judgment falls that a proper and genuine cartridge 18 is mounted. In this case, ON state of the switch 22*a* also indicates detection of installation of the process cartridge 18 into the printer body 20.

Figure 5:
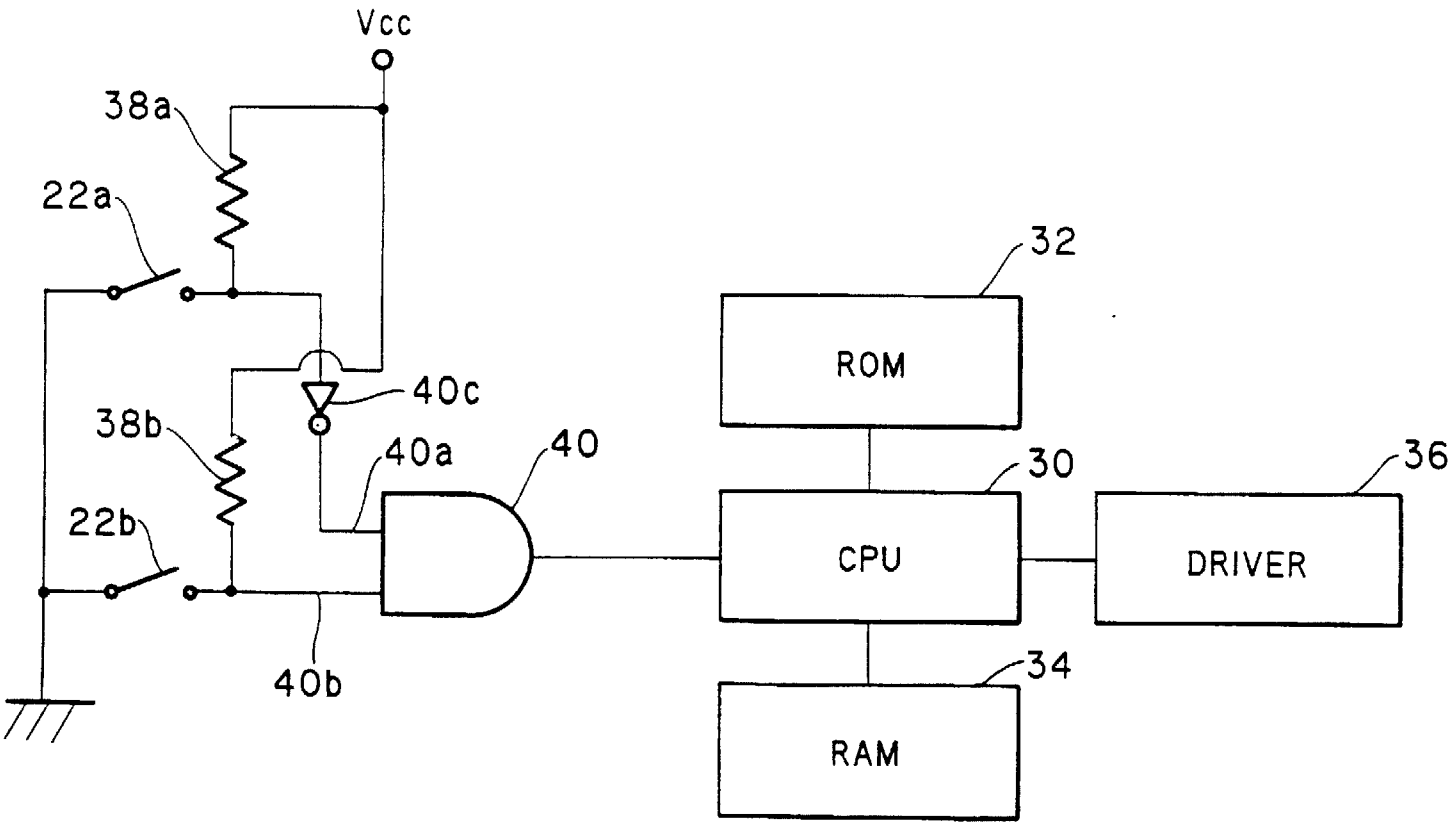
FIG. 5 is a block diagram illustrating a section for determining authenticity of the toner cartridge according to the first embodiment.

FIG. 5 shows a block diagram and a logic circuit in the printer body 20. The CPU 30 is connected to a ROM 32 storing therein a processing routine, a RAM 34 for temporarily storing therein data, a driving system 36 for driving various mechanisms of the printer body 20. Here, the various mechanisms include a sheet feed mechanism consisting by the sheet feed roller 105 for feeding the sheet, a developing mechanism such as the photosensitive roller 10, and an exposure mechanism for exposing the photosensitive roller 10.

An end of the detection switch 22*a* is connected to an input terminal 40*a* of an AND circuit 40 through an inverter 40*c*, and an end of the detection switch 22*b* is connected to the input terminal 40*b* of the AND circuit 40. Further, the ends of the detection switches 22*a* and 22*b* are also connected to a pull-up resistors 38*a*, 28*b*, respectively In addition, the other terminals of the detection switches 22*a* and 22*b* are grounded. An output terminal of the AND circuit 40 is connected to the CPU 30 for transmitting an authenticity detection/cartridge installation signal to the CPU 30.

Here, if the process cartridge 18 is not installed in the cartridge positioning portion 110, both the detection switches 22*a* and 22*b* are opened. Therefore, the input terminal 40*a* is rendered Low after passage of the inverter 40*c*, and the input terminal 40*b* is rendered High in both TTL level by the pull-up resistors 38*a* and 38*b*. Consequently, the output from the AND circuit 40 becomes Low. When a proper process cartridge 18 is installed, the detection switch 22*a* is closed (turned ON), and the detection switch 22*b* is opened (turned OFF). Therefore, the input terminal 40*a* is rendered High after passage of the inverter 40*c*, and the input terminal 40*b* is rendered High, so that the output from the AND circuit 40 becomes H.

On the other hand, when an improper process cartridge is inserted, the detection switch 22*a* is opened (turned OFF), or the detection switch 22*b* is closed (turned ON), so that the output of the AND circuit 40 becomes L. In this connection, the CPU 30 will generate driving signal for operating various mechanisms only when the output from the AND circuit 40 becomes H which is indicative of installation of the proper process cartridge 18.

Figure 6:
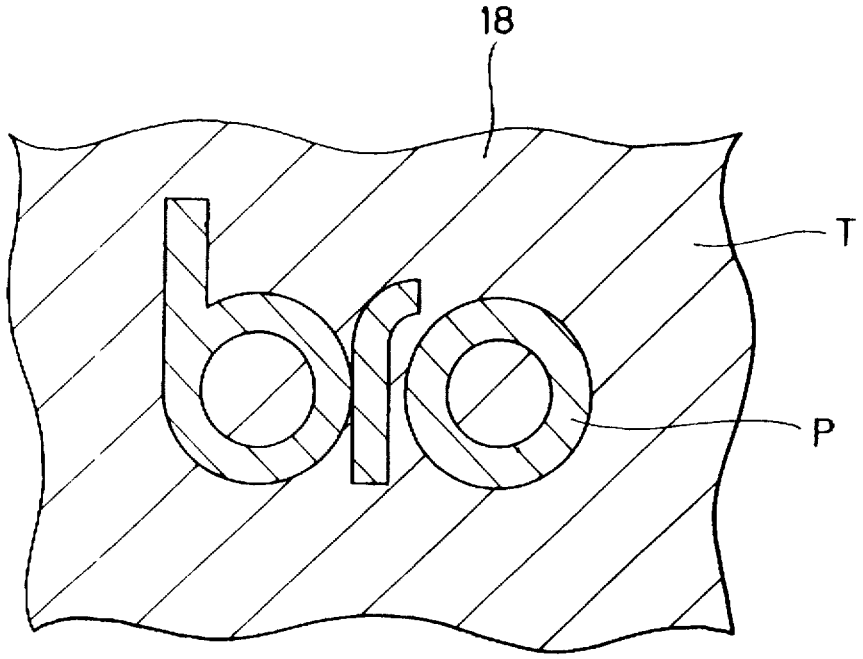
FIG. 6 is a diagram showing recessed and projected regions of the uneven pattern.

In this case, as shown in FIG. 6, the detection switch 22*a* is mounted on the detection circuit board 115 at the position in confrontation with any one of the projected or raised regions T of the uneven pattern (the surface of the process cartridge 18), while the detection switch 22*b* is mounted on the detection circuit board 115 at a position in confrontation with any one of the recessed or grooved regions P. With such arrangement, if the detection switch 22*a* does not detect the projected portion at the selected position, and/or if the detection switch 22*b* does not detect the recessed portion at the selected position, the installed cartridge is judged to be non-genuine cartridge.

Particularly, since the uneven pattern is a logo mark indicating the name of a manufacturer or product, even if a pirated cartridge bearing such logo mark is distributed in the market, it is immediately controlled under legislation such as the Trademark Law, whereby only genuine products are distributed in the market so that it becomes possible to protect the user from troubles due to use of an inferior pirated cartridge.

Figure 7:
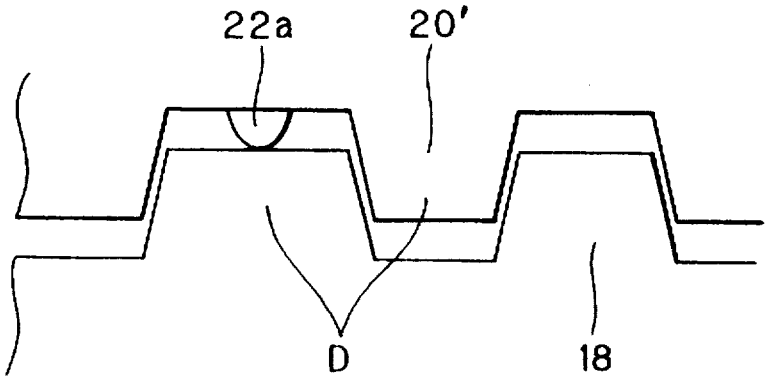
FIG. 7 is a diagram showing a modification to the first embodiment with respect to detection positions of a printer body.

FIG. 7 shows a modification to the first embodiment with respect to a printer body 20'. According to the modification, tapered projections D are also provided on the printer body 20', thereby accurately positioning the cartridge 18 with respect to the printer body, to thus accurately establish the detection positions of the detection switches **22*a* and 22*b*. The projections D facilitate positioning of uneven pattern on the cartridge with respect to the detection switches 22*a*, 22*b* on the printer body 20'**.

As described above, in the image output device according to the embodiment, with respect to the single uneven pattern formed on the cartridge, the position of at least one projected point and at least one recessed point is provisionally determined, and position of at least one detection switch for detecting the one projected point and the position of at least one detection switch for detecting the one recessed point is, also provisionally determined on the printer body. If a genuine cartridge is installed in the printer body, the projected point surely confronts the detection switch for detecting the projected point, and the recessed point surely confronts the detection switch for detecting the recessed point. Accordingly, the installed cartridge can be recognized as the genuine cartridge. In order to meet this condition, the pirated cartridge should provide completely identical uneven pattern at every part thereof as long as the pirate does not recognize the actual detecting positions. Accordingly, it would be difficult to manufacture the pirated products, and thus, it is possible to prevent the image output device from being damaged by the pirated cartridge, or it is possible to avoid formation of a degraded output image by the employment of the pirated cartridge. Further, since the detection switch for detecting the uneven pattern is sufficient to detect only part of the uneven pattern, a compact size of the cartridge results, and production cost can be lowered.

Further, if the logo mark is used as the uneven pattern for identifying the name of a product or company, it becomes unavoidable to form the name of brand or product of the manufacturer, which causes the pirated product to falsely bear the name of manufacturer or product. Consequently, it cannot be distributed in the market. Consequently, only the genuine cartridge can be distributed in the market, so that unnecessary confusion is not caused for the user.

An image output device according to a second embodiment of the present invention will be described with reference to FIGS. 8 and 9.

Figure 8:
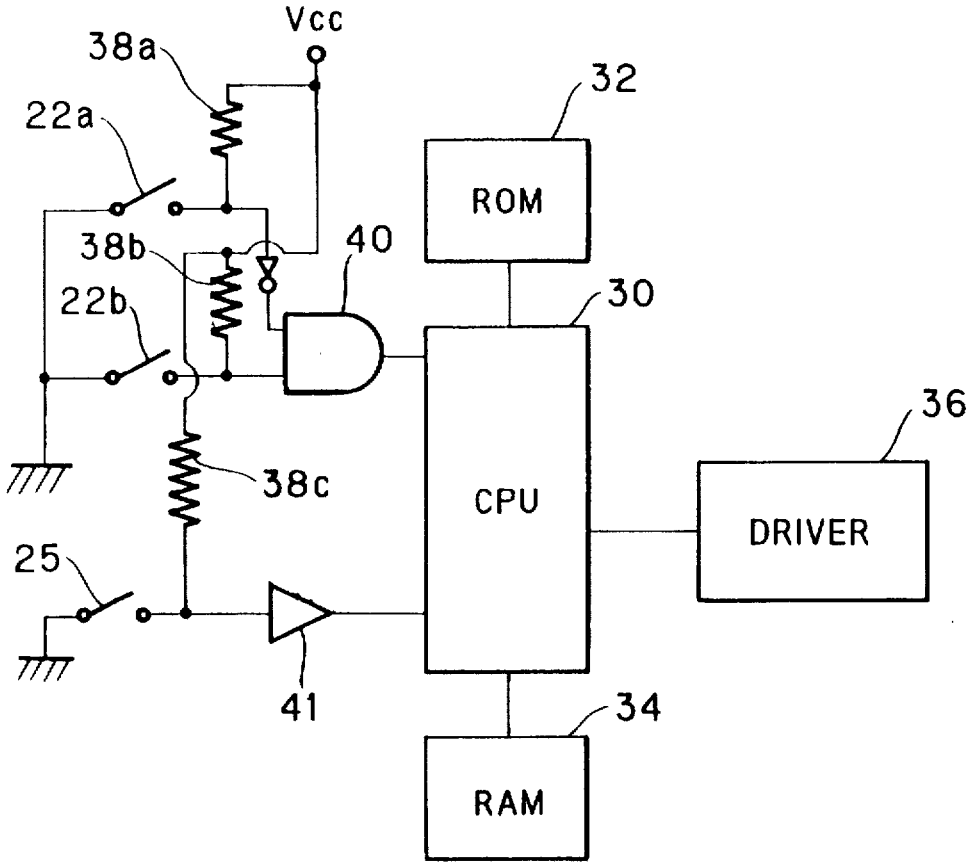
FIG. 8 is a block diagram showing a section for determining authenticity of a toner cartridge according to a second embodiment of the present invention.
Figure 9:
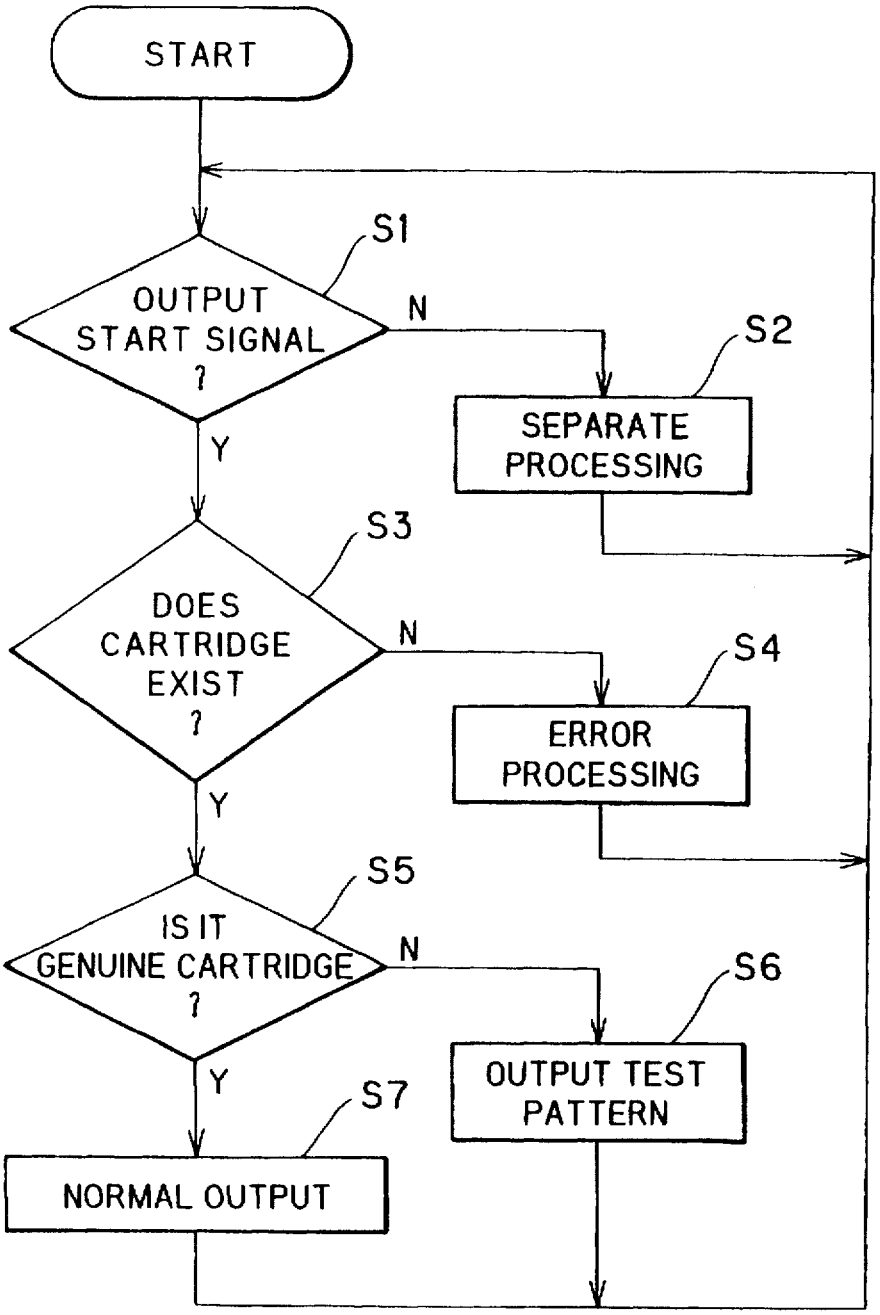
FIG. 9 is a flowchart illustrating a control routine executed by a central processing unit according to the second embodiment.

As shown in FIG. 8, an electrical circuit according to the second embodiment includes the circuit shown in FIG. 4 and a switch 25 for detecting installation of the process cartridge 18 on the printer body 20. That is, the switch 25 is of a normally open contact type similar to the detection switches **22*a* and 22*b*, and is closed (turned ON) when the process cartridge 18 is installed. One end of the switch 25 is grounded, while another end is connected to an input terminal of an inverter 41 which is also connected to a pull-up resistor 38*c*. An output terminal of the inverter 41 is connected to the CPU 30. That is, when the process cartridge 18 is not mounted, the input terminal of the inverter 41 becomes H level, and its output terminal outputs a L level signal. When the process cartridge 18 is mounted, the output terminal of the inverter 41 outputs a H level signal. The central processing unit 30 can determine mounting of the process 18 on the basis of the High level signal from the inverter 41**.

Next, an operation on the determination of cartridge by the CPU 30 will be described with reference to a flowchart of FIG. 9.

First, in step S1, for starting image outputting operation, image data are retrieved in an output buffer of the RAM 34, and judgment is made as to whether or not image output start signal is inputted. If the image output start signal has not yet been inputted, the routine goes into step S2 to execute another processing, and the routine goes back to the step S1. When the image output start signal is input (S1:Yes), the routine proceeds into step S3 where installation of the cartridge is checked. That is, if the signal from the inverter 41 is at L level, judgment is made that the cartridge has not yet been installed (S3:No), so that the routine goes into S4 where error processing is executed, that is error sound is generated and operation of the driving system 38 is prohibited, and the routine returns back to S1.

On the other hand, if the signal from the inverter 41 is at H level (S3:Yes), the routine proceeds into step S5 where property of the installed cartridge is checked. That is, if the signal from the AND circuit 40 is at Low level, the judgment in S5 falls No which is indicative of installation of improper or non-genuine cartridge. Then, in Step S6, the image data stored in the output buffer are transferred into a pass-by area, and then, a test pattern stored in a ROM 32 is retrieved in the output buffer, and thereafer, the test pattern is outputted so that an operator can recognize the installation of non-genuine cartridge. More specifically, an electrostatic latent image corresponding to the test pattern is formed on the photosensitive roller 10 upon irradiation of the laser beam by an optical scanner. Toner image corresponding to the latent image is formed on the photosensitive roller 10, and the toner image is transferred onto the sheet by the transfer roller 101, and the sheet carrying the test pattern is discharged outside the printer body through the sheet discharge port E. Accordingly, the operator can immediately know an abnormal state on the image output device, because the test pattern different from the intended image is outputted. If the test pattern includes an indication indicating that the process cartridge 18 installed in the printer body 20' is a pirated product, the operator can promptly understand the reason of the abnormality. In addition, by checking printing quality of the test pattern, it becomes apparent that the printing performance by the pirated cartridge is different from that of the genuine cartridge.

On the other hand, if the output of the AND circuit 41 is at H level (S5:Yes), determination falls that a genuine process cartridge 18 is installed. Then, the routine goes into step S7 where image outputting operation is executed on the basis of the image data stored in the output buffer. In this way, CPU 30 suppresses the image outputting operation if the pirated cartridge is detected in its installing position, but generates the test pattern. This eliminates the possibility that the operator recognizes the image output to be improper.

Next, an image output device according to a third embodiment of the present invention will be described with reference to FIGS. 10 and 11.

In the first and second embodiments, one detection switch is exclusively used for detecting the specific recessed point, and the other detection switch is exclusively used for detecting the specific projected point. In contrast, according to the third embodiment, a detection switch can be used for detecting either the recessed point or the projected point in accordance with the detecting positions of the uneven pattern. In other words, the third embodiment can change-over the detection state for the uneven pattern between the recessed region detection state and the raised region detection state depending on the detection position of the detection switch.

Figure 10:
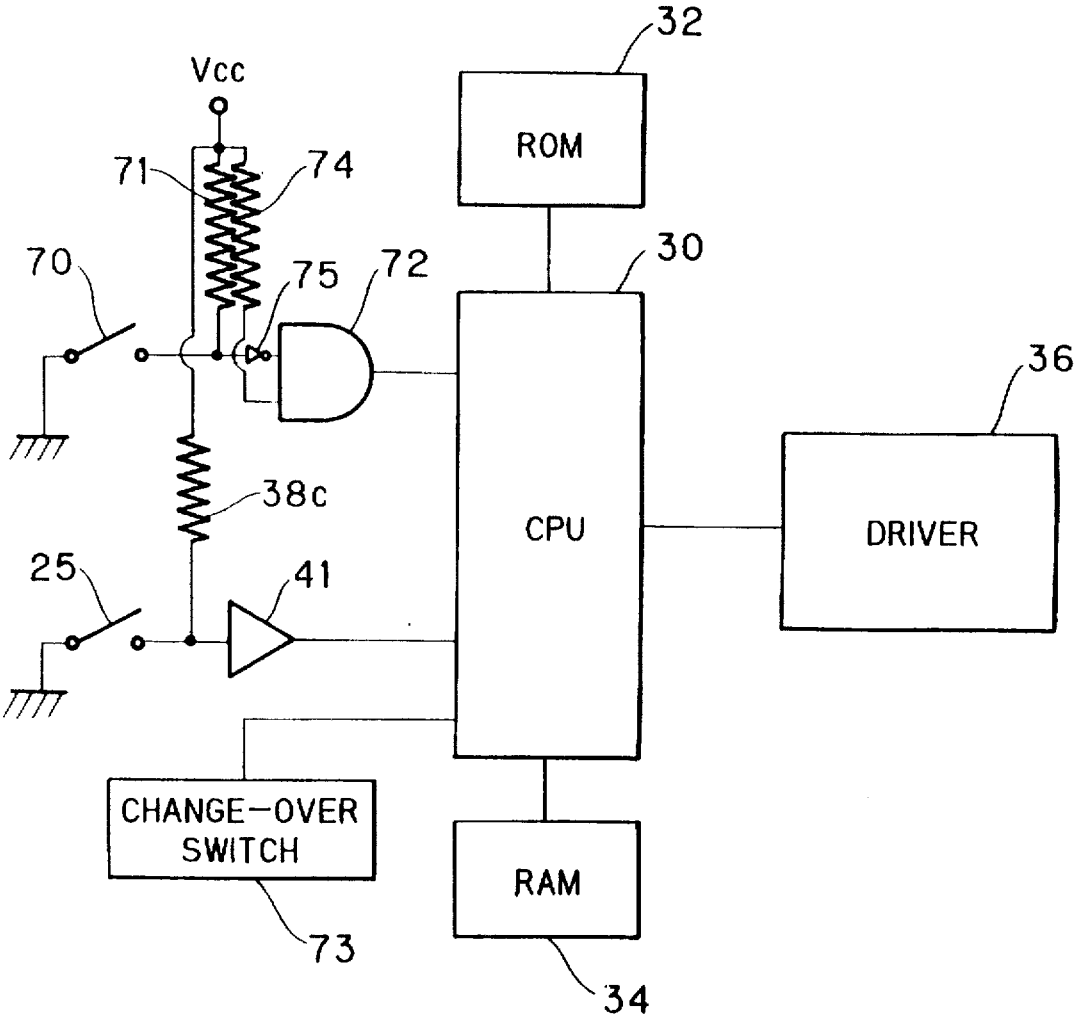
FIG. 10 is a block diagram showing a section for determining authenticity of a toner cartridge according to a third embodiment of the present invention.
Figure 11:
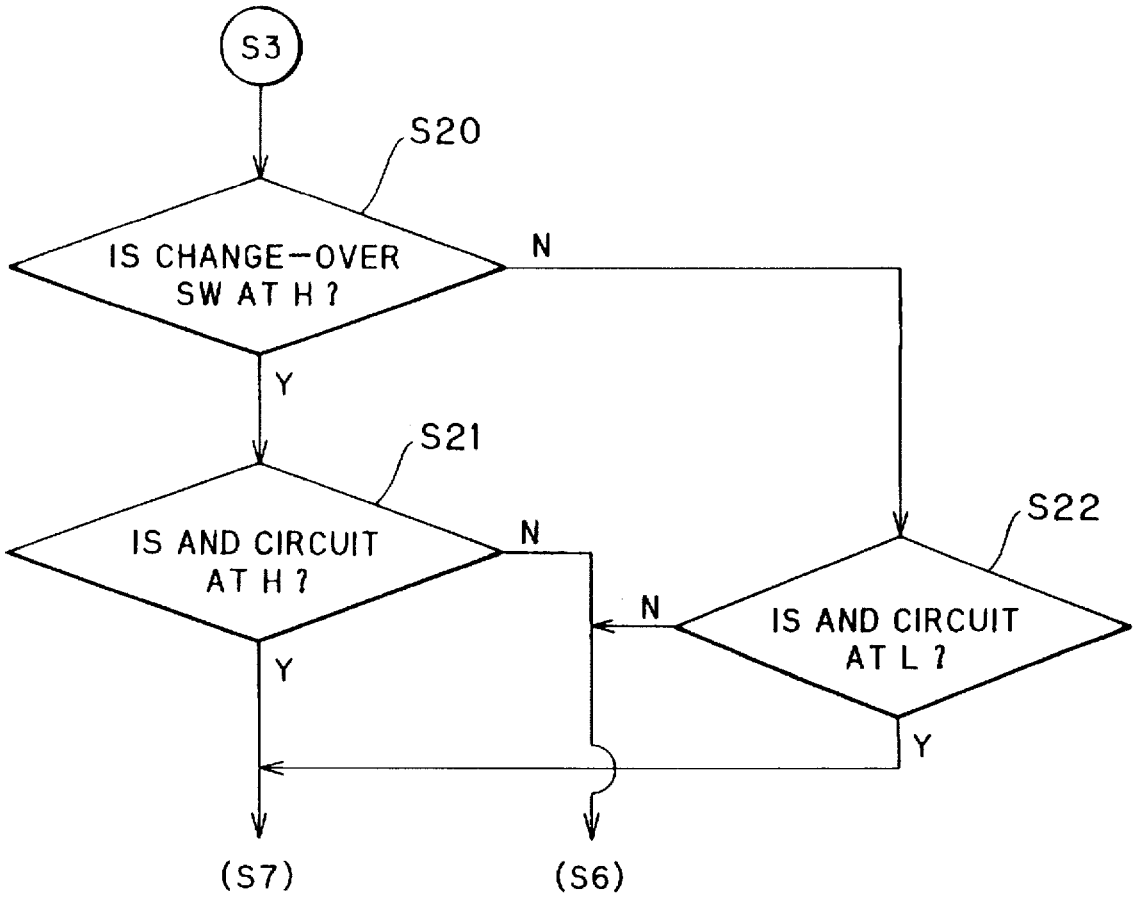
FIG. 11 is a flowchart showing a control routine executed in a central processing unit according to the third embodiment.

In an electrical circuit shown in FIG. 10, like parts and components are designated by the same reference numerals as those shown in the foregoing embodiments. The control circuit includes a single switch 70 for determining authenticity of a cartridge. The switch 70 is a normally open contact type switch similar to the detection switch 22*a*. One end of the switch 70 is grounded, while the other end is connected to an AND circuit 72 through an inverter 75. A pull-up resistor 71 is connected to the inverter 75. Further, the input terminal of the AND circuit 72 is also connected to a pull-up resistor 74. When the switch 70 is closed (turned ON), an output of the AND circuit 72 becomes H level, while, when it is opened (turned OFF), the output of the AND circuit 72 becomes L level. The output of the AND circuit 72 is transmitted into the CPU 30. The CPU 30 is connected to a change-over switch 73, which will be described later.

The position of the switch 70 on the circuit board is varied by the predetermined number of production lots, and its detection position is either the recessed or projected region of the uneven pattern. As shown in FIG. 3, even for detection at the recessed region, the detection position can be selected from a great number of points such as P1, P2, . . . , and, even for detection at the raised region, the detection position can be selected from a great number of points such as T1, T2, . . . .

The change-over switch 73 may be, for example, a two-position stable toggle switch having an operating knob. When the operating knob is at a first position, the raised region detection state can be provided, and an H level signal is output to the CPU 30. When the operating knob is at a second position, the recessed region detection state can be provided, and a L level signal is output.

Then, the operation routine in the third embodiment will be described with reference to the flowchart of FIG. 11. However, in the third embodiment, since only the determination routine of the step S5 in the flowchart of FIG. 9 is replaced with steps S20 through S22, and therefore, detailed description is given only for the steps S20 through S22.

Similar to the second embodiment, when the desired image data are stored in the output buffer, and installation of a cartridge is detected based on the High level signal from the inverter 41, the level of a signal from the change-over switch 73 is determined. If the signal from the change-over switch 73 is judged to be High level signal (S20:Yes), the switch 70 is judged to provide the raised region detecting state. Therefore, the routine goes into step S21 where the output level from the AND circuit 72 is judged. If the genuine cartridge is installed, the output signal from the AND circuit 72 is the High level signal (S21:Yes) because of the ON state of the switch 70. Then, the routine goes into the step S7 (see FIG. 9) to perform image outputting operation. On the other hand, if the pirated cartridge is installed, the switch 70 remains open (turned OFF), so that the output signal from the AND circuit 72 is the Low level signal (S21:No). Therefore, judgment can be made that the installed cartridge is the pirated cartridge, and the routine proceeds into step S6 (FIG. 9).

On the other hand, if the signal from the change-over switch 73 is judged to be Low level signal (S20:No), the switch 70 is judged to provide the recessed region detecting state. Then, the routine goes into step S22 where the output level from the AND circuit 72 is judged. If the switch 70 is rendered ON in spite of the recessed region detecting state, the output signal from the AND circuit 72 is High level signal (S22:No), so that judgment can be made in that the installed cartridge is the pirated cartridge. Therefore, the routine goes into step S6. On the other hand, if the switch 70 is rendered OFF, the output signal from the AND circuit 72 is Low level signal (S22:Yes). Therefore, the determination can be made in that the genuine cartridge is installed. Then, the routine goes into the step S7.

In this way, in accordance with the change in mounting position (detecting position) of the switch 70, the change-over switch 73 is changed over. Therefore, authenticity of a cartridge can be easily determined with only one switch 70. For example, a plurality of mounting positions for mounting the switch 70 are prepared on the circuit board, and the switch 70 is mounted on a specific mounting position among the plurality of mounting positions by a chip mounter controlled by a computer. If the mounted position corresponds to the recessed region detecting position, the operation knob of the change-over switch 73 is changed-over to the second position, and if the mounted position corresponds to the raised region detecting position, the operation knob of the change over switch 73 is changed over to the first position. Further, accurate change-over operation can be provided by correlating and storing in a memory the mounting position of the switch 70 and the position of the operating knob of the change-over switch 73, and by indicating with a print on the circuit board the position of the operation knob of the change-over switch 73.

Figure 12:
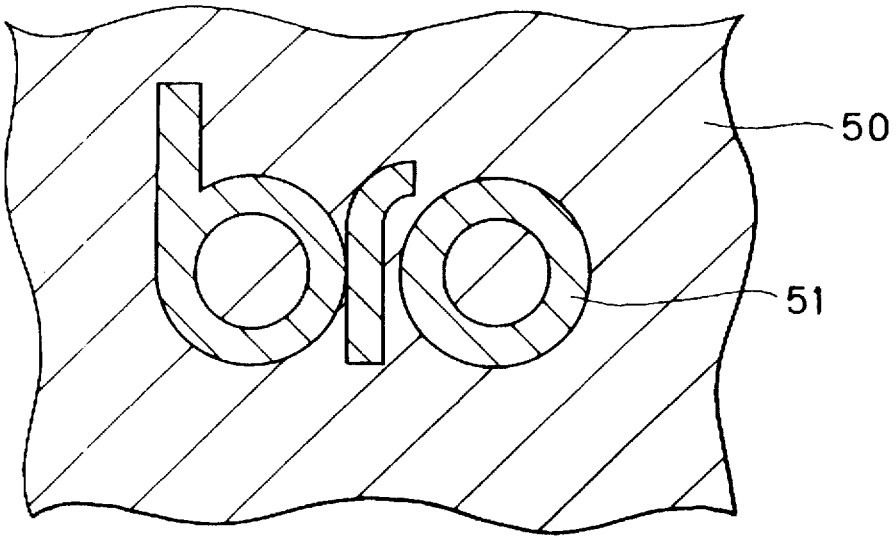
FIG. 12 is a view showing an electrically conductive pattern of a circuit board which constitutes a part of a detection switch according to a modified embodiment of the present invention.
Figure 13:
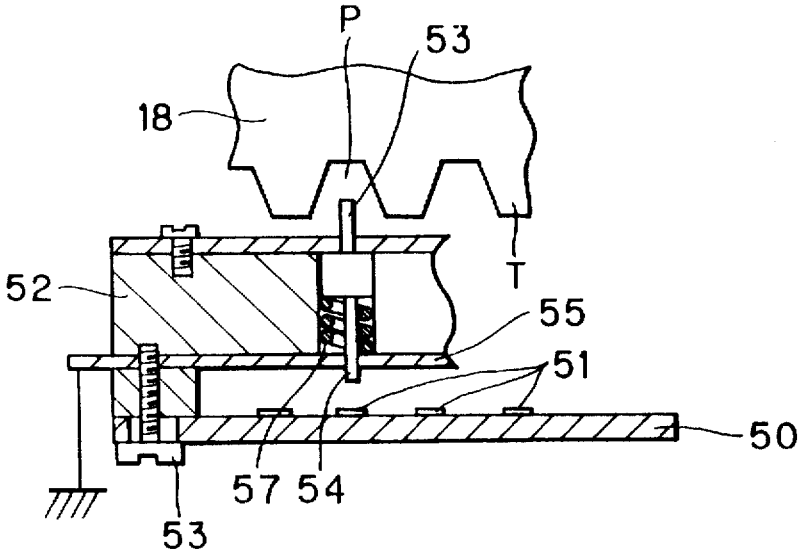
FIG. 13 is a partial cross-sectional view showing the detection switch according to the modified embodiment shown in FIG. 12 and a part of the toner cartridge shown in FIG. 6.

FIGS. 12 and 13 show one example of the switch 70. The switch 70 includes a circuit board 50 formed with a sheet like electrically conductive pattern 51 corresponding to the uneven pattern shown in FIGS. 2 and 6. An insulating switch holder 52 is secured to the circuit board 50 by a screw 53 in such a manner that relative position of the switch holder 52 with respect to the circuit board 50 is adjustable. A switch pin 53 is axially movably supported by the switch holder 52. The switch pin 53 has one end provided with an electrode 54 and in confrontation with the circuit board 50 and another end in confrontation with the uneven surface pattern PT of the cartridge 18. The switch pin 53 is normally urged in a direction away from the conductive pattern 51 by a spring 57. An electrically conductive brush plate 55 is also supported by the screw 53. The brush plate 55 is grounded, and is contactable with the electrode 54 when the switch pin 53 is moved toward the circuit board 50 against the biasing force of the spring 57. Therefore, an electrical contact between the electrode 54 and the electrically conductive pattern 51 is detected. Further, a pull-up resistor is connected to the conductive pattern 51.

When the other end of the switch pin 53 is in confrontation with the raised region of the uneven pattern PV, the switch pin 53 is moved toward the circuit board 50 and is brought into contact with the conductive pattern 51. In this case, because the electrode 54 is slidably contacted with the grounded brush plate 55 and the pull-up resistor is connected to the conductive pattern 51, potential of the conductive pattern 51 changes to zero as the movable electrode 54 contacts the conductive pattern 51. When the other end of the switch pin 53 is in confrontation with the recessed region of the uneven pattern PV, the switch pin 53 is moved away from the circuit board 50. In this case, potential of the conductive pattern 51 maintains high level. Accordingly, judgment as to the installation of the genuine cartridge can be made based on the change in potential.

If the switch holder 52 is laterally moved, and if the tip end of the electrode 54 is brought into contact with a surface of the circuit board 50 other than the electrically conductive surface 51, the potential of the conductive pattern 54 does not change even if the switch pin 53 is pressed.

Thus, to attain accurate detection, it is necessary to position the conductive pattern 51 and the uneven pattern on the cartridge 18 to be exactly opposite each other. That is, if the conductive pattern 51 is formed in correspondence to the recessed region of the uneven pattern, the cartridge is positioned and secured so that the conductive pattern is disposed at a position corresponding to the recessed region of the uneven pattern when the cartridge is installed at a position.

According to the third embodiment, the change-over switch 73 changes over the detection state between the recessed region detection state and the raised region detection state depending on the detection position. Therefore, the detection switch can be changed over between the recessed region detection state and the raised region detection state depending on its detection position. Thus, only one detection switch can detect both recessed and raised pattern.

Further, in the third embodiment, because the position of the switch pin 53 relative to the electrically conductive pattern 51 can be changed, i.e., detecting position can be changed, and the switch pin 53 can be selectively used for detecting either the raised part or the recessed part of the uneven pattern by the change-over operation of the change-over switch 73, any position of the uneven pattern becomes a subject to the detection. Accordingly, only a cartridge having the correct uneven pattern in its entirety can be detected as a genuine cartridge.

While the invention has been described in detail and with reference to the specific embodiments thereof, it would be apparent to those skilled in the art that various changes and modifications may be made therein without departing from the spirit and scope of the invention. For example, in the first embodiment, the uneven pattern is formed by the recessed pattern. However, the uneven pattern may be constituted by a raised rib projecting from the surface of the cartridge 18. In this case, it is not necessary to change height of the rib, but the rib can have a uniform projecting height.

Further, in the second embodiment, the test pattern is printed if improper cartridge is installed in the printer body in the step S6. However, instead of the test pattern, image output operation can be prohibited similar to the step S4. Furthermore, instead of outputting the test pattern, or instead of the suppression of the image formation, it may be possible to form an electrostatic latent image on the photosensitive roller 10 based on the image data stored in the output buffer, and to periodically change bias voltage when depositing the toner onto the photosensitive roller. As a result, the resultant image includes white line stripes. In essence, any approaches suppressing normal image output may be employed as long as the operator can recognize the installation of the pirated cartridge into the printer body.

Furthermore, the illustrated embodiment concerns the electrophotographic printer. However, the present invention can be applied to an ink jet printer on which a cartridge containing ink is removably mounted, or a tape printer on which a cartridge containing tape and an ink ribbon is removably mounted, and in which a desired image is outputted onto the tape through the ink ribbon with a thermal transfer system. Furthermore, although a mechanical type switch is used as the detection switch in the above described embodiment, it is not limited to such type, but a photointerrupter including a light emitting element and light receiving elements is also available.

What is claimed is:

1. An image output device to be used in combination with a cartridge; the cartridge comprising:

a cartridge wall containing therein an image forming medium; and a predetermined uneven pattern formed on an outer surface of the cartridge wall, the uneven pattern including a projected region containing a plurality of projected points and a recessed region containing a plurality of recessed points; and the image output device comprising:

a cartridge installing portion for detachably installing therein the cartridge, the cartridge installing portion providing a detecting position;

means for detecting unevenness of the uneven pattern at the detecting position, the detecting position being previously determined so as to confront with a predetermined one of the plurality of projected or recessed points in the uneven pattern, and the detecting means generating a signal indicative of either a projected point or recessed point;

means for suppressing image outputting operation based on the detection signal from the detecting means if the detecting means detects one of the projected or recessed points other than the predetermined one of the projected or recessed points; and second detection means for detecting installation of the cartridge into an operative position in the cartridge installing portion.

2. The image output device as claimed in claim 1, wherein the uneven pattern comprises a logo mark for identifying a name of a product or company.

3. The image output device as claimed in claim 2, wherein the uneven pattern comprises grooves formed in the cartridge wall, the grooves providing the logo mark.

4. The image output device as claimed in claim 2, wherein the uneven pattern comprises ribs projecting from the outer surface, the ribs having uniform projecting height and providing the logo mark.

5. The image output device as claimed in claim 1, wherein the cartridge comprises a toner cartridge for performing electrophotographic type printing in the image outputting operation.

6. The image output device as claimed in claim 1, wherein the cartridge comprises an ink cartridge for performing ink ejection type printing in the image outputting operation.

7. The image output device as claimed in claim 1, wherein the cartridge comprises a tape cartridge housing therein an ink ribbon and a tape-like image receiving member.

8. The image output device as claimed in claim 1, further comprising:

means for generating a warning image other than an intended image on an image receiving medium when the cartridge is installed in the operative position but the detecting means detects one of the projected or recessed points other than the predetermined one of the projected or recessed points.

9. An image output device to be used in combination with a cartridge; the cartridge comprising:

a cartridge wall containing therein an image forming medium; and a predetermined uneven pattern formed on an outer surface of the cartridge wall, the uneven pattern including a projected region containing a plurality of projected points and a recessed region containing a plurality of recessed points; and the image output device comprising:

a cartridge installing portion for detachably installing therein the cartridge, the cartridge installing portion providing a detecting position;

means for detecting unevenness of the uneven pattern at the detecting position, the detecting position being previously determined so as to confront with a predetermined one of the plurality of projected or recessed points in the uneven pattern, and the detecting means generating a signal indicative of either a projected point or recessed point; and means for suppressing image outputting operation based on the detection signal from the detecting means if the detecting means detects one of the projected or recessed points other than the predetermined one of the projected or recessed points, wherein the detecting position of the detecting means is changeable in and around the uneven pattern, and wherein the image output device further comprising a change-over means changing over detection state of the detecting means between a recessed region detection state and a projected region detection state depending on the detecting position.

10. An image output device to be used in combination with a cartridge, the cartridge comprising:

a cartridge wall containing therein an image forming medium; and a predetermined uneven pattern formed on an outer surface of the cartridge wall, the uneven pattern including a projected region containing a plurality of projected points and a recessed region containing a plurality of recessed points; and the image output device comprising:

a cartridge installing portion for detachably installing therein the cartridge, the cartridge installing portion providing a detecting position;

means for detecting unevenness of the uneven pattern at the detecting position, the detecting position being previously determined so as to confront with a predetermined one of the plurality of projected or recessed points in the uneven pattern, and the detecting means generating a signal indicative of either a projected point or recessed point; and means for suppressing image outputting operation based on the detection signal from the detecting means if the detecting means detects one of the projected or recessed points other than the predetermined one of the projected or recessed points, wherein the detecting means comprises a first detection switch provided at a specific detecting position in confrontation with a specific projected point of the uneven pattern, and a second detection switch provided at another specific detecting position in confrontation with a specific recessed point; and wherein the suppressing means generating a suspension signal for suspending the image output operation if the first detection switch generates a detection signal indicative of detection of a recessed point among the recessed region or if the second detection switch generates a detection signal indicative of detection of a projected point among the projected region.

11. The image output device as claimed in claim 10, wherein at least one of the first and second detection switches is movable along the uneven pattern.

12. The image output device as claimed in claim 11 wherein at least one of the first and second detection switches also serves as means for detecting installation of the cartridge into the cartridge installing portion.

13. A method for determining authenticity of a cartridge installed on a cartridge receiving portion of a body of an image output device, the method comprising steps of:

forming a predetermined uneven pattern of a cartridge containing therein expendables, the uneven pattern including a projected region containing a plurality of projected points and a recessed region containing a plurality of recessed points;

determining at least one specific detecting position;

correlating the specific detecting position with a specific point of the uneven pattern so as to determine the detecting position as being a position in confrontation with one of a predetermined projected points or recessed points;

judging whether or not the detecting position confronts one of the predetermined projected points or the recessed points;

determining authenticity of the cartridge installed in the cartridge receiving portion based on the judging step; and detecting installation of the cartridge into an operative position in the cartridge receiving portion.

14. The method as claimed in claim 13, wherein the determining step comprises the step of determining the cartridge installed in the cartridge receiving portion as being a genuine cartridge only if the judging steps makes judgment in that a relationship between the detecting position and the detected one of the projected or recessed point meets with the co-relation.

15. A method for determining authenticity of a cartridge installed on a cartridge receiving portion of a body of an image output device, the method comprising steps of:

forming a predetermined uneven pattern of a cartridge containing therein expendables, the uneven pattern including a projected region containing a plurality of projected points and a recessed region containing a plurality of recessed points;

determining at least one specific detecting position;

correlating the specific detecting position with a specific point of the uneven pattern so as to determine the detecting position as being a position in confrontation with one of a predetermined projected points or recessed points;

judging whether or not the detecting position confronts one of the predetermined projected points or the recessed points;

determining authenticity of the cartridge installed in the cartridge receiving portion based on the judging step; and varying the detecting position for detecting the uneven state at a selected part of the uneven pattern.

16. The method as claimed in claim 15, wherein the detection position is varied at every production lot in production of the cartridge.

17. The method as claimed in claim 16, wherein a detection switch is used at the detection position for detecting a region of the uneven pattern in confrontation with the detection switch, and the method further comprising the step of changing-over a detection mode of a detection switch between a recessed region detection state and a projected region detection state in accordance with the change in the detection position.

18. A method for determining authenticity of a cartridge installed on a cartridge receiving portion of a body of an image output device, the method comprising steps of:

forming a predetermined uneven pattern of a cartridge containing therein expendables, the uneven pattern including a projected region containing a plurality of projected points and a recessed region containing a plurality of recessed points;

determining at least one specific detecting position;

correlating the specific detecting position with a specific point of the uneven pattern so as to determine the detecting position as being a position in confrontation with one of a predetermined projected points or recessed points;

judging whether or not the detecting position confronts one of the predetermined projected points or the recessed points;

determining authenticity of the cartridge installed in the cartridge receiving portion based on the judging step; and generating a warning image other than an intended image in an image receiving medium if the judging steps makes judgment in that the relationship between the detecting position and the detected one of the projected or recessed point does not meet with the correlation.

19. The method as claimed in claim 18, wherein the warning image comprises a test pattern including a notification of installation of a non-genuine cartridge.

20. The method as claimed in claim 18, wherein the warning image comprises a striped intended image.

* * * * *